United States Patent [19]

Kitrell

[11] Patent Number: 4,597,210

[45] Date of Patent: Jul. 1, 1986

[54] DECORATIVE ITEM AND METHOD OF MAKING THE SAME

[76] Inventor: John V. Kitrell, 4639 Holdrege, Lincoln, Nebr. 68503

[21] Appl. No.: 603,090

[22] Filed: Apr. 23, 1984

[51] Int. Cl.[4] ..... G09F 13/20

[52] U.S. Cl. ..... 40/542

[58] Field of Search ..... 40/615, 219, 900, 542; 428/201, 202, 203, 915; 355/132, 133

[56] References Cited

U.S. PATENT DOCUMENTS

| | | | |
|---|---|---|---|
| 297,741 | 4/1884 | Babcock | 40/542 |
| 809,698 | 1/1906 | Kelley | 40/219 |
| 4,444,607 | 4/1984 | Lash et al. | 428/913 |

FOREIGN PATENT DOCUMENTS

| | | | |
|---|---|---|---|
| 3200694 | 7/1983 | Fed. Rep. of Germany | 40/542 |
| 11691 | 9/1916 | United Kingdom | 40/542 |

*Primary Examiner*—Gene Mancene
*Assistant Examiner*—Cary E. Stone
*Attorney, Agent, or Firm*—Zarley, McKee, Thomte, Voorhees & Sease

[57] ABSTRACT

A decorative item comprising a transparent sheet of plastic material having front and back sides with the material to be reproduced being positioned on the back side of the sheet. A coating of paint covers the back side of the sheet and the reproduced material. A protective backing sheet is positioned adjacent the painted back side of the sheet. The reproduced material is visible from the front side of the sheet with the paint creating a background for the reproduced material. The item is produced by first making a master copy of the material which will appear on the item. A transparency is then made of the master copy so that the material to be reproduced is positioned on the back side of the transparency. The back side of the transparency is then painted so that a colored background is created for the reproduced material. An optional protective backing sheet may then be placed on the painted back side of the transparency after the paint has dried.

3 Claims, 5 Drawing Figures

DECORATIVE ITEM AND METHOD OF MAKING THE SAME

BACKGROUND OF THE INVENTION

This invention relates to a decorative item and the process or method for producing the same so that treasured documents, club and fraternal emblems, school insignias, family crests, or any other types of items may be inexpensively reproduced.

Treasured documents such as diplomas, honorable discharges, awards, etc. are normally stored in safety deposit boxes or the like to prevent their inadvertent loss or destruction. Since it is desirable to be able to display the documents or the like without fear of inadvertent destruction or loss, reproductions of the same are sometimes created to enable the reproduction to be displayed in a prominent location. The customary reproduction processes are quite expensive and are normally not very decorative.

It is therefore a principal object of this invention to provide a method of producing a decorative item.

A further object of this invention is to provide a method of reproducing treasured documents, club and fraternal emblems, school insignias, family crests, or other types of items.

Yet another object of this invention is to provide a method of inexpensively producing specialties such as awards, cards, plaques, crests, albums, logos and treasured documents.

Yet another object of the invention is to provide a method for producing decorative items wherein the printed material appearing thereon will have a colored background so as to enhance the appearance of the printed material and item.

These and other objects will be apparent to those skilled in the art.

SUMMARY OF THE INVENTION

A master copy of the material to be reproduced or created is first prepared. A transparency of the master is then created so that the material to be reproduced is positioned on the back side of the transparency. The back side of the transparency is then spray painted with one or more cooats of paint so that a colored background is created for the reproduced material. A protective backing sheet is then placed on the painted back side of the transparency after the paint has dried. The finished item is highly decorative in that the reproduced material is visible from the front side of the transparency with the paint providing a decorative background for the reproduced material.

DESCRIPTION OF THE PREFERRED EMBODIMENT AND METHOD

Figure 1:
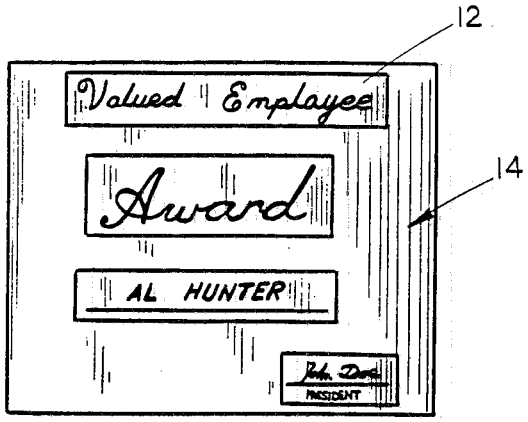
FIG. 1 is a plan view illustrating the material to be reproduced being pasted on a paste-up sheet.
Figure 2:
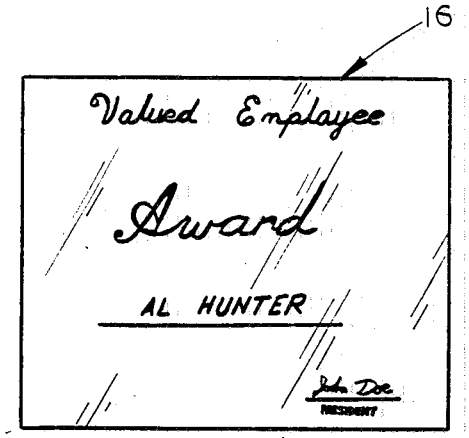
FIG. 2 is a plan view illustrating a transparency which has been created from the master copy of FIG. 1.
Figure 3:
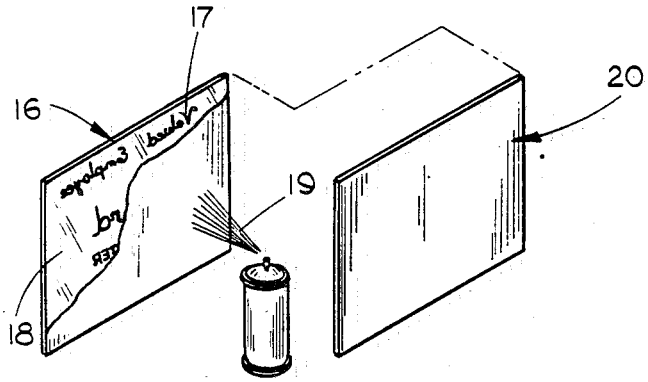
FIG. 3 is a view illustrating the back side of the transparency of FIG. 2 being sprayed with paint.
Figure 4:
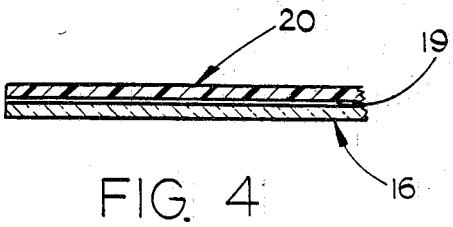
FIG. 4 illustrates a backing sheet being positioned on the painted item of FIG. 3.
Figure 5:
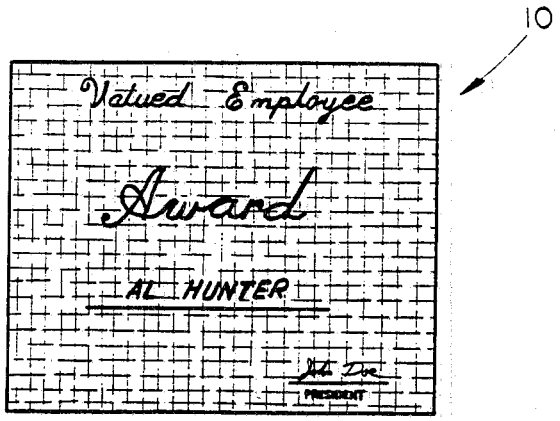
FIG. 5 is a front view of the finished item.

The numeral 10 refers generally to the finished decorative item of this invention. FIG. 1 illustrates the first step normally employed to create the decorative item. In FIG. 1, the material to be reproduced is referred to generally by the reference numeral 12. Material 12 is "pasted up" on a paste-up sheet 14. For purposes of description, the material to be reproduced will be described as being "copy". The copy 12 can consist of anything that will reproduce in the copy machine process and may be printed, hand drawn, or items that have been photocopied and then enhanced into an outline form. For example, if a diploma or the like is to be reproduced, a photocopy of the diploma is made and the photocopy pasted to the sheet 14. Conventional copying processes may then be employed to either enlarge or reduce the size of the copy. In some cases, it is not necessary to paste the copy material onto a sheet 14 since the material to be reproduced could form the master copy. Once the master copy has been prepared, the sheet 14 is then passed through a conventional photocopy machine to create a transparency of the master. Normally, the transparency will have the emulsion forming the copy on the front thereof. A second transparency is then created, from the first transparency, so that the emulsion or printed material is on the back side of the transparency. For purposes of description, the transparency is referred to by the reference numeral 16. In the transparency 16, the back side 18 has the reproduced material appearing thereon in the form of an emulsion 17.

The next step in the process is to apply spray enamel paint 19 to the back side 18 of the transparency. A bright gold color is the preferred color but other colors may also be used. The paint is applied to the back side of the transparency in mist coats. The mist coating is preferably repeated several times, allowing a few minutes between coats, until the copy material is completely covered. The paint is then allowed to dry.

Although it is not necessary, it is preferred that a backing sheet 20 be applied to the back side of the transparency after it has been painted. A suitable backing sheet is the conventional "contact paper" available from many different sources. The protective paper is stripped from the backing sheet and the backing sheet is applied to the back side of the transparency. The item 10 is then ready for framing. The finished item is extremely attractive in that the paint 19 provides a decorative background for the printed or reproduced material which is visible through the transparency. Inasmuch as the printed material or emulsion and the paint is on the backside of the transparency, the transparency, when placed in a frame, will be extremely durable since the reproduced material and paint is not exposed to the atmosphere.

The finished item 10 permits treasured documents or the like to be displayed without fear that the original will be destroyed or lost. The resulting product or item is extremely decorative and is relatively inexpensive to reproduce.

Thus it can be seen that the invention accomplishes at least all of its stated objectives.

I claim:

1. The method of reproducing material and producing a decorative item containing that reproduced material, comprising the steps of:

making a master copy of the material to be reproduced and which will appear on the item, making a photocopy transparency of the master copy by a photocopy machine so that the reproduced material is positioned on the back side of the transparency, and painting the back side of the transparency so that a colored background is created for the reproduced material.

2. The method of claim 1 wherein a protective backing sheet is placed on the painted back side of the transparency after the paint has dried.

3. The method of claim 1 wherein said step of making a photocopy transparency comprises placing said master copy on a photocopy machine, operating the machine to produce a first transparency with the emulsion forming the copy of the front side thereof, placing said first transparency on a photocopy machine and operating the machine to produce said photocopy transparency with the emulsion forming the copy on the back side thereof.

* * * * *